United States Patent [19]

Epper et al.

[11] 4,378,906

[45] Apr. 5, 1983

[54] SOLID JACKET CENTRIFUGE FOR MATERIAL EXCHANGE BETWEEN LIQUIDS

[75] Inventors: Wolfgang Epper, Bergheim; Theodor Paschedag, Beckum, both of Fed. Rep. of Germany

[73] Assignee: Klöckner-Humboldt-Deutz AG, Fed. Rep. of Germany

[21] Appl. No.: 283,941

[22] Filed: Jul. 16, 1981

[30] Foreign Application Priority Data

Jul. 17, 1980 [DE] Fed. Rep. of Germany ..... 3027020

[51] Int. Cl.³ ..... B04B 1/20

[52] U.S. Cl. ..... 494/54; 494/22; 494/43; 494/53; 494/56

[58] Field of Search ..... 233/7, 3, 6, 20 R, 20 A, 233/46, 47 R, 8, 9

[56] References Cited

U.S. PATENT DOCUMENTS

| | | | |
|---|---|---|---|
| 3,098,820 | 7/1963 | Gooch | 233/7 |
| 3,279,687 | 10/1966 | Amero | 233/7 |
| 3,955,756 | 5/1976 | Hiller | 233/7 |
| 4,303,192 | 12/1981 | Katsume | 233/7 |

*Primary Examiner*—Robert W. Jenkins

*Attorney, Agent, or Firm*—Hill, Van Santen, Steadman, Chiara & Simpson

[57] ABSTRACT

A jacketed centrifuge for exchanging material between liquids, usually a heavier liquid containing suspended solids and a lighter liquid, including a housing in which there is a drum mounted for rotation, and a conveyor worm mounted for rotation coaxially therewith. Inlet and outlet means are provided for introducing a relatively light liquid into the drum, as well as introducing the heavier liquid containing the solids suspended therein. Many of the elements of novelty are centered around the discharge means which are used for discharging solids from the drum. Basically, the drum is enlarged radially in the vicinity of the discharge means and is provided with various types of devices for discharging the solids into the discharge zone in a controlled manner. The preferred form of the discharge means comprises nozzles which are distributed along the periphery of the drum, cooperating with an apertured disk which is driven by the conveyor worm and which functions as a regulating means for regulating the flow of solids through the nozzles.

10 Claims, 6 Drawing Figures

SOLID JACKET CENTRIFUGE FOR MATERIAL EXCHANGE BETWEEN LIQUIDS

BACKGROUND OF THE INVENTION

1. Field of the Invention

The present invention is in the field of jacketed centrifuges for material transfer between liquids, and includes a coaxial drum and conveyor worm assembly, with improved discharge means for separating the solids from the remaining liquids.

2. Description of the Prior Art

In jacketed centrifuge assemblies which customarily operate according to the counterflow principle, a relatively high specific gravity liquid containing suspended solids is brought into contact with a lighter specific gravity liquid which is suitable for use as an extraction agent. The contact takes place in a material exchange zone of the centrifuge drum. Prior to their discharge, the liquids are subjected to another clarification step. The centrifuge thus produces three fractions, the relatively light liquid loaded with extract, a relatively heavy extracted liquid, and a solids fraction.

Counterflow centrifuges of this type are shown in German AS 1,037,417. In this patent, there is disclosed a cylindrical drum into which a heavy liquid is introduced in proximity to the rotational axis, and is guided by means of channels having a spiral shape into countercurrent relation to a light liquid which is fed into the circumferential region of the drum under pressure. The material exchange process takes place in the spiral-shaped channels. At the outermost circumferential region, and in the region next to the axis of rotation, there are clarifying zones provided for the heavy and light liquids. Consequently, the solids together with the heavy liquid are removed by means of a channel which begins at the outermost circumferential region. The disadvantage of this type of centrifuge is that essentially only those solids can be discharged which are kept in suspension with the heavy liquid and can be removed as a suspension. It is not possible to continuously discharge solids which are heavier in specific density than the relatively heavy liquid.

There is a centrifuge described in German Pat. No. 2,701,763 wherein a heavy liquid containing solids is passed into the exchange zone of a drum which tapers conically in the direction toward both faces, the liquid being directed in countercurrent relation to a relatively light liquid. The heavy liquid is introduced in a region existing closer to the axis of rotation of the drum than the light liquid so that the latter must be fed in under pressure. On both sides of the material exchange zone there are located clarifying zones for the heavy and light liquid. The discharge of the solids proceeds with the assistance of a conveyor worm acting on the heavy liquid. In one form of the invention, there is a drying zone following the clarifying zone for the heavy liquid, such drying zone tapering conically in the direction of a solid discharge. The discharging of the heavy liquid takes place by means of a dip tube which projects into the drum. The disadvantage of this type of centrifuge is that the heavy liquid adhering to the solids flows in the drying zone oppositely to the conveying direction of the solids to the dip tube. Consequently, solids which have a weak, yeast-like consistency and have a density about that of the heavy liquid are taken up and discharged together with the heavy liquid. A mixture of such solids with the heavy liquid is particularly disadvantageous when the heavy liquid is subjected to a subsequent distillation in order to recover any extraction agent present. A further disadvantage is the fact that the light liquid must be fed into the drum under pressure. This requires an arrangement of pressure increasing elements in the conduit carrying the light liquid, resulting in an additional energy requirement.

SUMMARY OF THE INVENTION

The present invention provides a solid jacket centrifuge which in addition to providing for an effective material exchange, makes possible a satisfactory separation and removal of the constituents in an economical operation. In accordance with the present invention, the drum is enlarged radially in the vicinity of the discharge means. The expanded portion of the drum can be used advantageously as a dewatering zone for the solids. Consequently, this dewatering zone can be designed so that a transport of the solid material proceeds by means of a conveyor worm. There is also the possibility of conveying solid particles by virtue of the geometry of the dewatering zone alone with the help of centrifugal forces acting on the solid particles in the direction of the discharge. By means of the expanded drum region in the solid discharge device, an unnecessary whirling motion of the solid layer conveyed by the worm and its deposit on the outermost edge of the drum are avoided.

In one embodiment of the invention, the solid discharge device has an essentially radial conveying direction. In this embodiment, the driving force can be derived from the centrifugal force during discharge so that special discharge elements need not be provided.

In a further embodiment of the invention, the drum is essentially cylindrical, and is conically expanded in the region of the solid discharge device. In this form of the invention, in the cylindrical part of the drum, the solid discharge process can be carried out, whereby the solid fraction is then conveyed by means of a conveyor worm into the conically expanded region for dewatering and subsequent discharge.

In a further embodiment of the invention, the solid discharge device includes several nozzles distributed over the circumference of the drum as well as at least one regulating element for regulating the solid flow. The regulating element may be a disk provided with slots or apertures which is mounted on the shaft of the conveyor worm in the interior of the drum. By means of regulating the speed of rotation between the conveyor worm and the drum, as well as the phase relationship of the angle of rotation, the flow through of the solids between a maximum value and a complete blockage may be achieved continuously. In this manner, there is an optimum possibility for controlling the layer thickness of the solids located in the drum.

In a preferred form of the invention, the drum may be provided with pipes equally spaced from the axis of rotation of the drum for separate removal of the liquids. This structure results in subjecting the heavy and light liquids approximately to equal radial acceleration, and evens out the discharge of the liquid. These pipes can cooperate with channels for the removal of the liquids, such channels being equipped with stop disks. These regulating stop disks bring about a backup during flow guidance, so that by means of their radial position, they act to control the level in the pipes.

Finally, the drum may be provided with symmetrically disposed inlet chambers for the liquids having preferably the same radial extension. With this arrangement, the liquids can be fed in at approximately the same radial level so that the light liquid can be fed in without substantial pressure. By means of the co-rotating inlet chambers, the liquids experience the radial acceleration corresponding to the speed of rotation of the drum or, of a conveyor worm, and proceed into the material exchange zones of the drum. Because of the open and pressure-free feed end, external pressure increasing elements are eliminated in the conduit for the light liquid, so that the energy requirements for the material exchange method are reduced.

BRIEF DESCRIPTION OF THE DRAWINGS

Further advantages and features of the present invention will be apparent from the following description of specific embodiments thereof.

DESCRIPTION OF THE PREFERRED EMBODIMENTS

Figure 1:
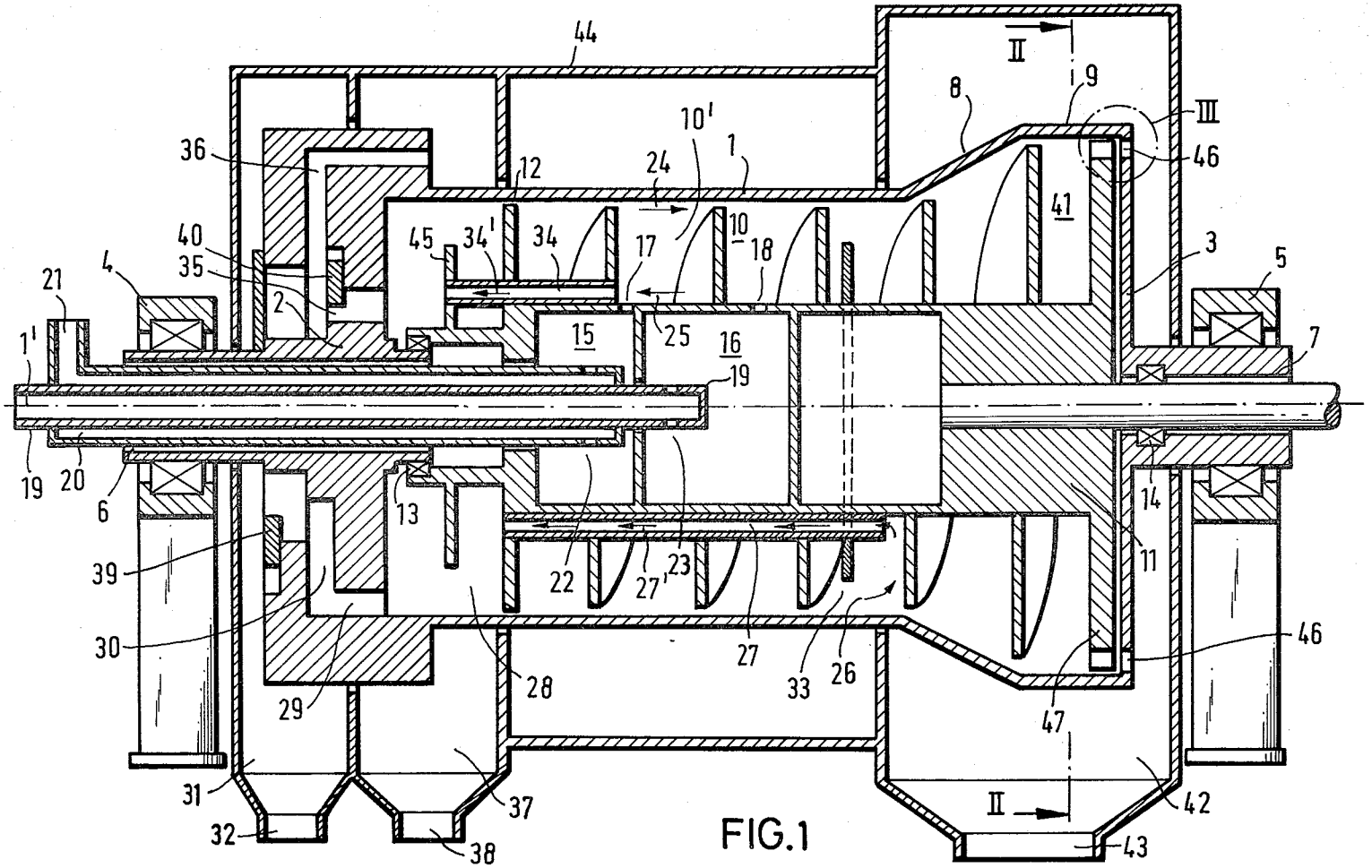
FIG. 1 illustrates a solid jacket centrifuge embodying the improvements of the present invention, in longitudinal cross section.

In FIG. 1, reference numeral 1 indicates generally a cylindrical drum having end plates 2 and 3 mounted for rotation in bearing supports 4 and 5. The portions of the end plates 2 and 3 which are received in the bearings are hollow shaft portions 6 and 7. The drive of the drum takes place by means of the hollow shaft 7 which is driven by a motor (not shown). The drum at the discharge end has a conically expanding section 8 which provides a smooth transition from the generally cylindrical body of the drum 1 into an expanded cylindrical part 9.

In the interior of the drum 1, there is a conveyor worm 10 whose shaft 11 is partially hollow and extends throughout the entire length of the interior of the drum 1. Reference numeral 12 has been applied to a sealing disk which seals the space between the drum 1 and the conveyor worm 10 in the axial direction.

The shaft 11 is held between spaced bearings 13 and 14 which are supported on the hollow shafts 6 and 7 extending from the front plates 2 and 3. The shaft 11 in its hollow portion spaced rearwardly from the conical expansion zone 8 of the drum is provided with two inlet chambers 15 and 16. A pair of apertures 17 and 18 are provided in the circumferential regions of these chambers. These apertures 17 and 18 connect the inlet chambers with the space between the walls of the drum 1 and the shaft 11 in which the material exchange process takes place. The conveyor worm 10 is driven by means of the shaft 11 which passes through the hollow shaft 7 coaxially by means of a separate motor (not shown).

A pipe 19 which is closed at one end is used for feeding in light liquid. This pipe extends through the hollow shaft 6 and the inlet chamber 15 into the inlet chamber 16. It is surrounded in the region of the inlet chamber 15 by means of a further pipe 20 which is closed at one end except for an aperture for receiving the pipe 19, and is used for feeding in the heavy, high specific gravity liquid in which the solids are suspended. The pipe 20 is provided with an inlet 21 at one end. Both pipes 19 and 20 in the portions of those pipes extending in the inlet chambers 15 and 16 are provided with circumferential apertures 22 and 23, respectively.

The liquids fed in by means of the pipes 19, 20 and 21 pass through the apertures 22 and 23 into the inlet chambers 15 and 16 and are here accelerated, due to the rotational speed of the drum 1 or the worm 10 in the circumferential direction. The liquids then proceed under the influence of the centrifugal force through the apertures 17 and 18 located in the walls of the inlet chambers 15 and 16 into a material exchange zone 10' of the centrifuge. In the normal operating state of the centrifuge, the heavy liquid and the solid move in the direction of the arrow 24 and the light liquid moves in the direction of the arrow 25, countercurrently to the heavy liquid having the solids suspended therein.

The movement of the solids is accomplished by the difference in speed of rotation between the conveyor worm 10 and the drum 1, which difference is adjustable. The heavy liquid proceeds in the direction of the arrows 26 through a pipe 27 provided on the shaft 11, into a separating chamber 28 and then into channels 29 and 30. The channels 29 and 30 are formed within the face plate 2 of the drum 1 and deliver the material into a collecting vessel 31 to which a discharge conduit 32 is connected.

On the shaft 11 in the region next to the conical section 8 there is a barrier consisting of a stop disk 33 which prevents liqht liquid from being discharged together with heavy liquid in the direction of the arrow 26. The light liquid because of its low density thus cannot flow over the top of the stop disk barrier 33 in the direction of the inlet aperture of the pipe 27. There thus results, after the material exchange process, an effective separation of the liquids from each other. The light liquid can only flow out by means of a pipe 34 provided on the shaft 11 so that the liquids fed in the material exchange zone 10' are flowing in countercurrent relationship. The pipe 34 and the discharge pipe 27 are located at equal distances from the access of the drum 1 so that discharge of the liquids eventually evens out.

The light liquid proceeds into a separating chamber 28 and thence into channels 35 and 36 into a collecting vessel 37 which is provided with a discharge conduit 38. The direction of flow within the pipes 27 and 34 is indicated by means of arrows 27' and 34', respectively.

The channels 29, 30 on one side and 35, 36 on the other side are shown distributed over the circumference of the front plate 2, or the drum 1, and are displaced with respect to one another so that the sectional views below and above the center line 1' do not lie in the same plane.

Within the channels 29, 30, 35 and 36, there are barrier disks 39 and 40 which provide a uniform discharge of the liquids.

Figure 2:
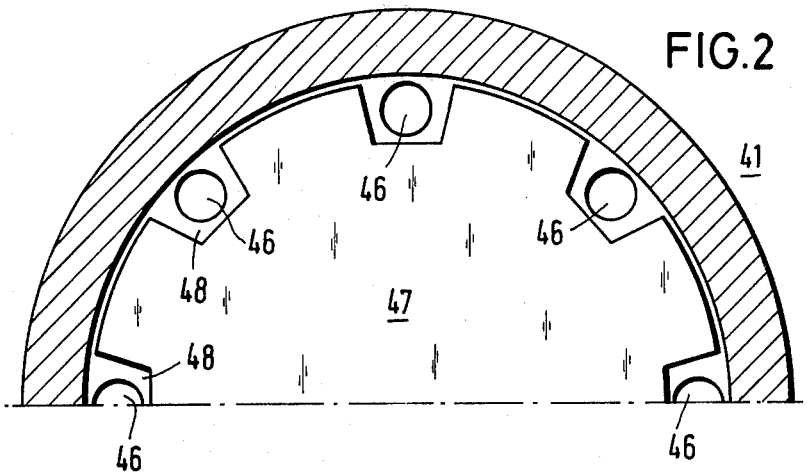
FIG. 2 is a fragmentary cross-sectional view taken substantially along the line II—II of FIG. 1.
Figure 3:
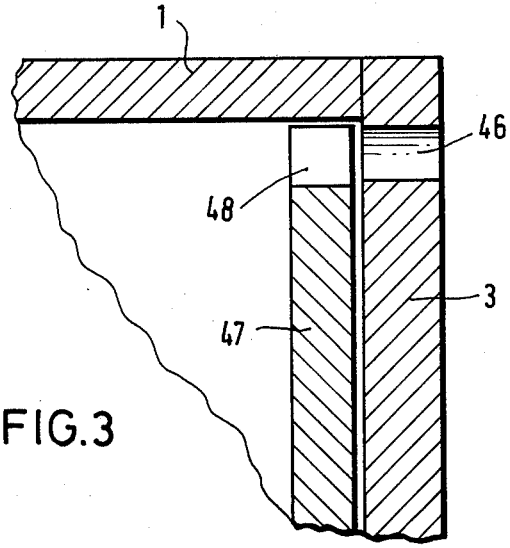
FIG. 3 is an enlarged cross-sectional view of that portion of the assembly of FIG. 1 denoted by the dashed line III.

After passage through the expanded cylindrical portion 8 of the drum 1, the solids are discharged by means of a solid discharge device generally indicated at reference numeral 41, such device being depicted in more detail in FIGS. 2 and 3. The solids proceed into a collection vessel 42 to which a solid discharge conduit 43 is connected. Collecting vessels 31, 37 and 42 all form a portion of the housing 44 in which the drum 1 is housed.

In the separating chamber 28, there is a disk 45 which is tightly secured to the worm 10 and is apertured to receive the pipes 34 in the axial direction. The disk 45 in the separating chamber 21 makes it possible to achieve an ordered flow of layers of the heavy and light liquid in the direction toward the channels 29, 30, or 35, 36.

The flights of the conveyor worm 10, as shown in the embodiment of FIG. 1, can extend in the axial direction over the entire region of the drum 1, including the conical expansion section 8 and the expanded cylindrical portion 9 in order to achieve a reliable transport of the solids. It is, however, also possible to arrange the flights only in the cylindrical portion of the drum 1, in particular when because of the conical expansion 8 the solid particles are conveyed in the directed toward the solid discharge device 41 by means of the effective centrifugal force alone.

As shown in detail in FIGS. 2 and 3 particularly, the solid discharge device 41 may include eight nozzles 46 distributed uniformly over the circumference of the front plate 3 which in the embodiment shown has an essentially axial outflow direction. In the interior of the drum, and located on the shaft 11, and rotating therewith is a disk 47 which is spaced only slightly from the front plate 3. The disk 47 has a number of trapezoidal-shaped recesses 48 corresponding in number to the number of nozzles 46, the angular distance between the recesses 48 corresponding to the angular distances between the nozzles 46. By turning the disk 47 with respect to the front plate 3, an opening or closing of the cross-sectional flow of the nozzles 46 can be achieved. There is thus the possibility of regulating the phase relationship between the angle of rotation of the conveyor worm 10 and the drum 1 as well as adjusting the difference of rotational speed to control the flow through of solids through the nozzles 46 in a simple manner. The disk 47 thus has the function of a flow regulating element.

Figure 4:
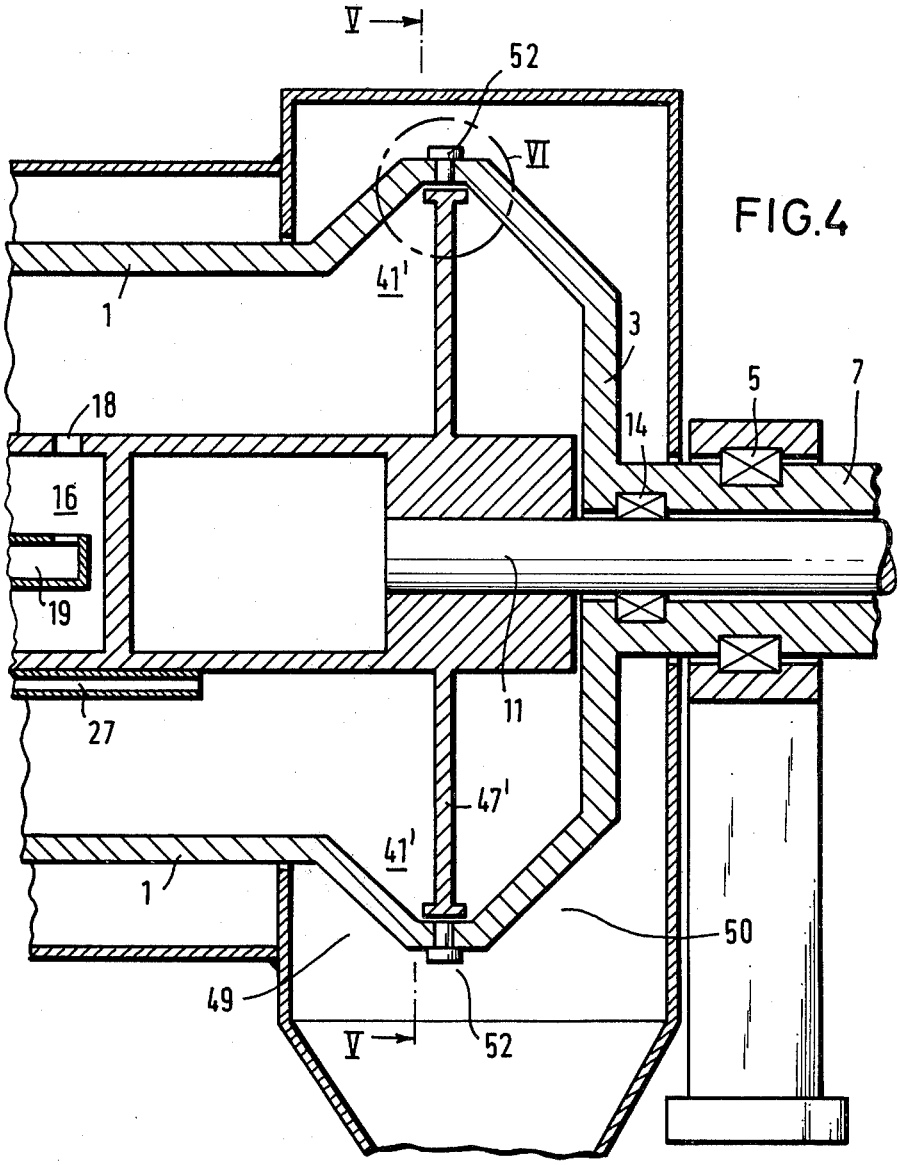
FIG. 4 is a fragmentary cross-sectional view of a further modified form of the invention in longitudinal cross section.

In FIG. 4 there is shown a further embodiment of the invention in partial cross section. In this particular embodiment the expanded end region of the drum 1 consists of two conical portions 49 and 50, one being a conically expanding portion and the other being a conical reducing portion. These two portions comprise a solid discharge device generally indicated at 41', the discharge being essentially radial. Otherwise, this embodiment corresponds in function to that described in FIG. 1.

Figure 5:
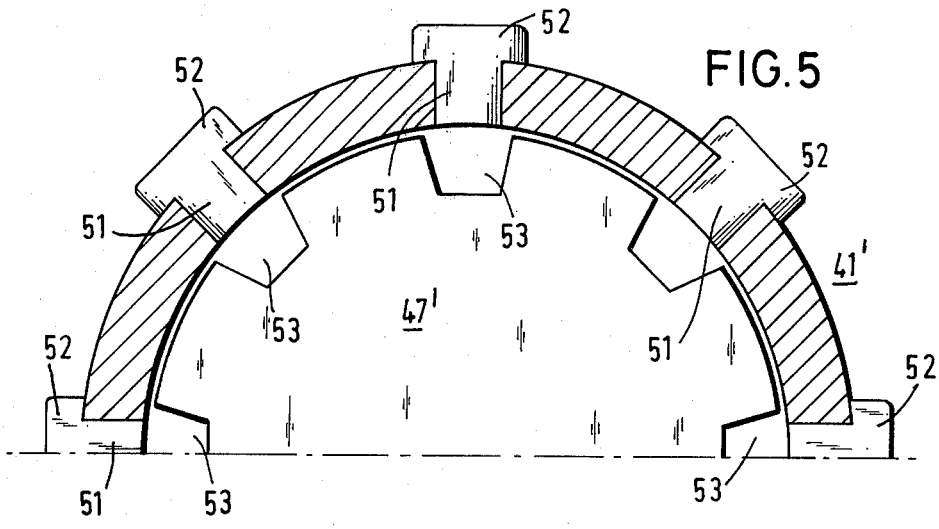
FIG. 5 is a fragmentary cross-sectional view taken substantially along the line V—V of FIG. 4.
Figure 6:
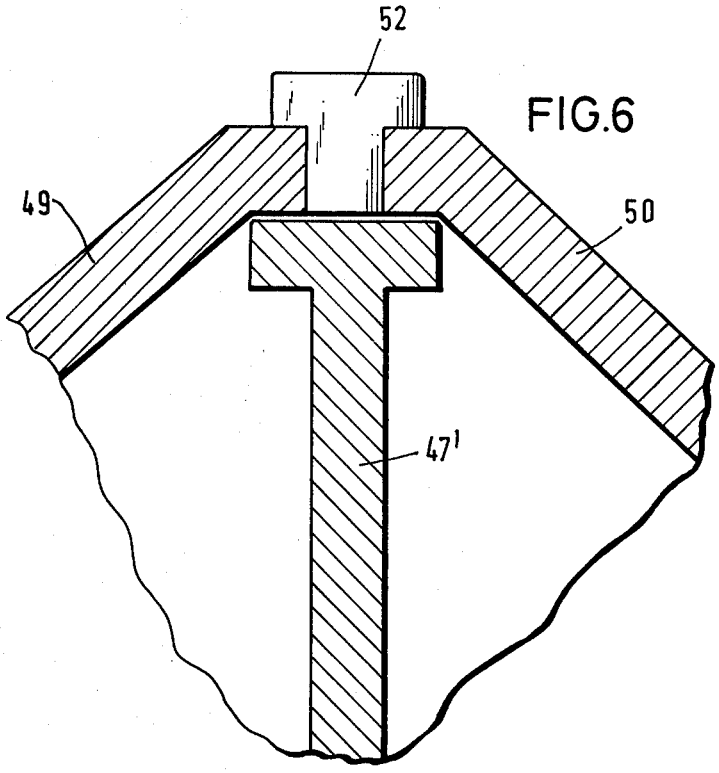
FIG. 6 is an enlarged cross-sectional view of that portion of the structure of FIG. 4 enclosed by the section line VI.

In FIGS. 5 and 6, there is a more precise showing of the construction of the solid discharge device 41' in FIG. 4. Specifically, at the expanded end region of the drum 1, eight apertures 51 are arranged, in which nozzles 52 are fastened. Opposite the nozzles 52 on the interior of the drum is the narrow side of a disk 47' which is fastened to the shaft 11 of the conveyor worm 10 for rotation therewith. The disk 47' on its circumference has a number of recesses 53 which correspond in number to the number of nozzles 52. The recesses are shown in trapezoidal shape, and having an angular spacing from one another corresponding to the spacing of the nozzles 52. In a similar manner to the structure described in FIGS. 2 and 3, by turning of the shaft 11 with respect to the drum 1, the cross section of the flow of the nozzles can be either increased or decreased.

It should be evident that various modifications can be made to the described embodiments without departing from the scope of the present invention.

We claim as our invention:

1. A jacketed centrifuge for exchanging material between liquids, at least one of which contains suspended solids, comprising:
   a housing,
   a drum mounted for rotation within said housing,
   a conveyor worm mounted for rotation coaxially with said drum,
   inlet and outlet means for introducing a relatively light liquid into said drum and withdrawing it from said drum,
   inlet and outlet means for introducing a heavier liquid having solids suspended therein into said drum and out of said drum, and
   discharge means for discharging solids from said drum,
   said drum having a larger cross-sectional area at said discharge means than at either inlet means, and said discharge means being located at the area of greatest radius of said drum.

2. A centrifuge according to claim 1 in which:
   the discharge of solids through said drum occurs in an axial direction.

3. A centrifuge assembly according to claim 1 in which:
   discharge of said solids through said drum is in a radial direction.

4. A centrifuge according to claim 1 in which:
   said drum is essentially cylindrical and has a conically expanding portion in the vicinity of said discharge means.

5. A centrifuge according to claim 1 in which:
   said drum is essentially cylindrical and has a conically expanding portion and a conical reducing portion beyond said conically expanding portion in the vicinity of said discharge means.

6. A centrifuge according to claim 1 which includes:
   a plurality of spaced nozzles distributed about the periphery of said drum, and
   regulating means cooperating with said nozzles to regulate the flow of solids therethrough.

7. A centrifuge according to claim 6 in which:
   said regulating means includes an apertured disk driven in unison with said conveyor worm.

8. A centrifuge according to claim 1 which includes:
   a barrier disk carried by said conveyor worm and functioning to divert light liquid from being discharged from said drum in combination with said heavier liquid.

9. A centrifuge according to claim 1 in which:
   said conveyor worm extends the full length of said drum.

10. A centrifuge according to claim 1 in which:
   the outlet means for said relatively light and relatively heavier liquids comprise pipes equally spaced from the axis of said drum.

* * * * *